US010259245B2

(12) United States Patent
Karlinski et al.

(10) Patent No.: US 10,259,245 B2
(45) Date of Patent: Apr. 16, 2019

(54) INDIRECT INKJET PRINTING SYSTEM

(71) Applicant: LANDA CORPORATION LTD., Rehovot (IL)

(72) Inventors: Haggai Karlinski, Ramat Gan (IL); Alon Siman-Tov, Or Yehuda (IL); Yehoshua Sheinman, Ra'anana (IL); Daniel Alkhanati, Nes Ziona (IL); Elad Pur Buchray, Nes Ziona (IL)

(73) Assignee: LANDA CORPORATION LTD., Rehovot ( * ) Notice: Subject to any disclaimer, the term of this patent is extended or adjusted under 35 U.S.C. 154(b) by 0 days.

(21) Appl. No.: 15/741,897

(22) PCT Filed: May 25, 2016

(86) PCT No.: PCT/IB2016/053049
§ 371 (c)(1),
(2) Date: Jan. 4, 2018

(87) PCT Pub. No.: WO2017/009722
PCT Pub. Date: Jan. 19, 2017

(65) Prior Publication Data

US 2018/0201038 A1 Jul. 19, 2018

(30) Foreign Application Priority Data

Jul. 10, 2015 (GB) ..... 1512145.2

(51) Int. Cl.
*B41J 29/377* (2006.01)
*B41J 2/005* (2006.01)
(Continued)

(52) U.S. Cl.
CPC ..... *B41J 29/377* (2013.01); *B41J 2/0057* (2013.01); *B41J 2/01* (2013.01); *B41J 2/16517* (2013.01);
(Continued)

(58) Field of Classification Search
CPC ..... B41J 2202/02; B41J 2/1714
See application file for complete search history.

(56) References Cited

U.S. PATENT DOCUMENTS 4,190,844 A * 2/1980 Taylor ..... B41J 2/09 347/82
5,517,214 A 5/1996 Bhatia et al.
(Continued)

FOREIGN PATENT DOCUMENTS

GB 1443679 A 7/1976
GB 2374834 A 10/2002
(Continued)

OTHER PUBLICATIONS

Co-pending U.S. Appl. No. 16/122,943, filed Sep. 6, 2018.

*Primary Examiner* — Shelby L Fidler
(74) *Attorney, Agent, or Firm* — Marc Van Dyke; Fourth Dimension IP

(57) ABSTRACT

A manifold is disclosed for introducing gas into a gap between a print head and an intermediate transfer member (ITM) of an indirect inkjet printing system. The manifold has a first gas flow path terminating in a first discharge mouth for delivering a continuous low speed gas stream and a second separate gas flow path terminating in a second discharge mouth, vertically spaced from the first discharge mouth, for intermittently delivering into the gap a high speed gas stream.

20 Claims, 5 Drawing Sheets

(51) Int. Cl.
*B41J 2/01* (2006.01)
*B41J 2/165* (2006.01)

(52) U.S. Cl.
CPC ..... *B41J 2002/012* (2013.01); *B41J 2202/02* (2013.01)

(56) References Cited

U.S. PATENT DOCUMENTS 5,528,271 A * 6/1996 Ebisawa ..... B41J 2/01 347/102
6,081,281 A * 6/2000 Cleary ..... B41J 2/02 239/270
6,220,693 B1 4/2001 Bode et al.
6,293,196 B1 9/2001 DeMoore et al.
6,491,364 B2 * 12/2002 Pietrzyk ..... B41J 2/04 347/21
7,915,091 B2 * 3/2011 Chew ..... H01L 21/56 438/127
9,539,817 B2 1/2017 Condello et al.
2002/0046670 A1 4/2002 Crystal et al.
2003/0016264 A1 * 1/2003 Jeannnaire ..... B41J 2/03 347/28
2008/0084465 A1 4/2008 Telken et al.
2009/0115825 A1 * 5/2009 Peng ..... B41J 2/04 347/92
2009/0244180 A1 * 10/2009 Panchawagh ..... B41J 2/02 347/44
2010/0060703 A1 3/2010 Ohara et al.
2011/0304868 A1 12/2011 Ohnishi
2012/0050410 A1 * 3/2012 Kwok ..... B41J 2/045 347/54
2014/0168313 A1 6/2014 Ramesh et al.

FOREIGN PATENT DOCUMENTS

GB 2518148 A 3/2015
JP 2017047536 A * 3/2017
WO 2013132424 A1 9/2013
WO WO2013132418 A2 9/2013

* cited by examiner

INDIRECT INKJET PRINTING SYSTEM

FIELD OF THE DISCLOSURE

The present disclosure relates to an indirect inkjet printing system.

BACKGROUND

There has previously been proposed by the present applicant, see for example WO2013/132418, a printing system in which, at an image forming station, an aqueous ink is jetted onto an endless belt or drum that serves as an intermediate transfer member (ITM). The resulting ink image is transported by the ITM to an impression station and, during its transportation, it is dried to leave behind a tacky ink residue. At the impression station, the ink residue is transferred onto a substrate and the ITM surface then returns to the image forming station to commence a new printing cycle.

Certain problems have been encountered during operation of such a printing system to which the solution has been found to be the blowing of a gas (air) stream through the gap traversed by the ink droplets from jetting nozzles of print heads mounted on a print bar to the surface of the ITM. These problems are briefly explained below:

First, the ITM is operated at an elevated temperature and the ink droplets start evaporating on impacting the ITM. The released water vapour then condenses on the cooler print heads and forms droplets, which eventually drip onto the ITM to damage the printed image. Preventing such condensation requires a fast gas stream and, because of the turbulence that it creates, such a stream can only be applied intermittently during periods when no jetting of ink is taking place, such as between pages or between print runs.

Second, when a droplet is jetted by a printing nozzle, it is often followed, a short time after it has separated from the printing nozzle, by a much smaller droplet, referred to as a satellite. Being emitted sequentially, the droplets and their satellites do not fall on the same point on the ITM and therefore result in some image dots on the substrate having a faint shadow caused by their satellites. To overcome this problem, it has been proposed to blow a constant steady laminar stream through the gap between the ITM and the print heads. The effect of this stream is to carry all droplets in the direction of movement of the ITM. However, because of their size, the smaller satellites are more strongly affected by the gas stream than the larger droplets and if the stream speed is carefully selected, the large droplets and the satellites merge into one another on reaching the surface of the substrate.

In the following description, the laminar stream for avoiding satellites is referred to as the low speed stream and the turbulent stream for dislodging condensation from the jetting heads is referred to as the high speed stream. Furthermore, the sources for supplying these two gas streams will be referred to as high pressure and low pressure supplies but the terms "low" and "high" are used only to distinguish the stream and supplies from one another.

The present disclosure seeks to provide a manifold that is capable of delivering both types of gas stream into the small gap at the image forming station between the print heads and the ITM.

SUMMARY

According to the present disclosure, there is provided a manifold for introducing gas into a gap between a print head and an intermediate transfer member (ITM) of an indirect inkjet printing system, the manifold having a first gas flow path terminating in a first discharge mouth for delivering a continuous low speed gas stream and a second separate gas flow path terminating in a second discharge mouth, vertically spaced from the first discharge mouth, for intermittently delivering into the gap a high speed gas stream.

The invention is predicated on the realisation that even though the gap between the print heads and the ITM is very small, typically one 1 mm to 2 mm, one needs to use two separate discharge mouths for the two gas streams and different gas flow paths must be used to conduct the two gas streams, because the two gas flow paths must fulfil different criteria.

In the case of the gas flow path supplying a low speed steady gas stream, it is important for it to be designed to produce streamlined flow that is even across the full width of the print bar carrying the different print heads.

In the case of the high speed gas flow, on the other hand, the flow should not be streamlined. Furthermore, equal distribution across the width of the print bar is not only inessential, but it is undesirable. A high speed gas flow causes a drop in pressure and if the pressure is dropped across the entire width of the print bar at the same time, it can cause the ITM to lift off its support surface.

In some embodiments of the invention, therefore, the gas flow path conducting the high speed gas is divided into a plurality of discrete branches and high speed gas is not made to flow through all the branches simultaneously.

Thus while the entire mouth delivering low speed gas may be connected to a common single plenum chamber of the manifold that is connected at all times during use to a source of gas at relatively low pressure, the mouth delivering high speed gas may be divided into regions each connected to a different respective plenum chamber that is only intermittently connected to a relatively high pressure gas supply.

In some embodiments, the manifold may comprise a block that, in use, is directly secured to a print bar that carries the print heads.

Each of the branches conducting high speed gas may comprise a plenum chamber connected to a supply of gas at high pressure and a buffer chamber intermittently connected to the latter plenum chamber by way of a respective valve, each of the buffer chambers being connected to a respective region of the second discharge mouth of the manifold.

In an embodiment, the two mouths of the manifold are defined by a top plate, a bottom plate and an intervening spacer that are secured to an underside of the block, the first discharge mouth, for the low speed gas, being defined between the top plate and the bottom plate and the second discharge mouth, for the high speed gas, being defined by groves in the upper surface of the top plate and the underside of the block.

The spacer may be shaped to define divergent channels each leading from a respective hole in the block, connected to the single plenum chamber of the first flow path, to the first discharge mouth.

BRIEF DESCRIPTION OF THE DRAWINGS

The invention will now be described further, by way of example, with reference to the accompanying drawings, in which.

DETAILED DESCRIPTION OF ILLUSTRATED EMBODIMENTS

Figure 1:
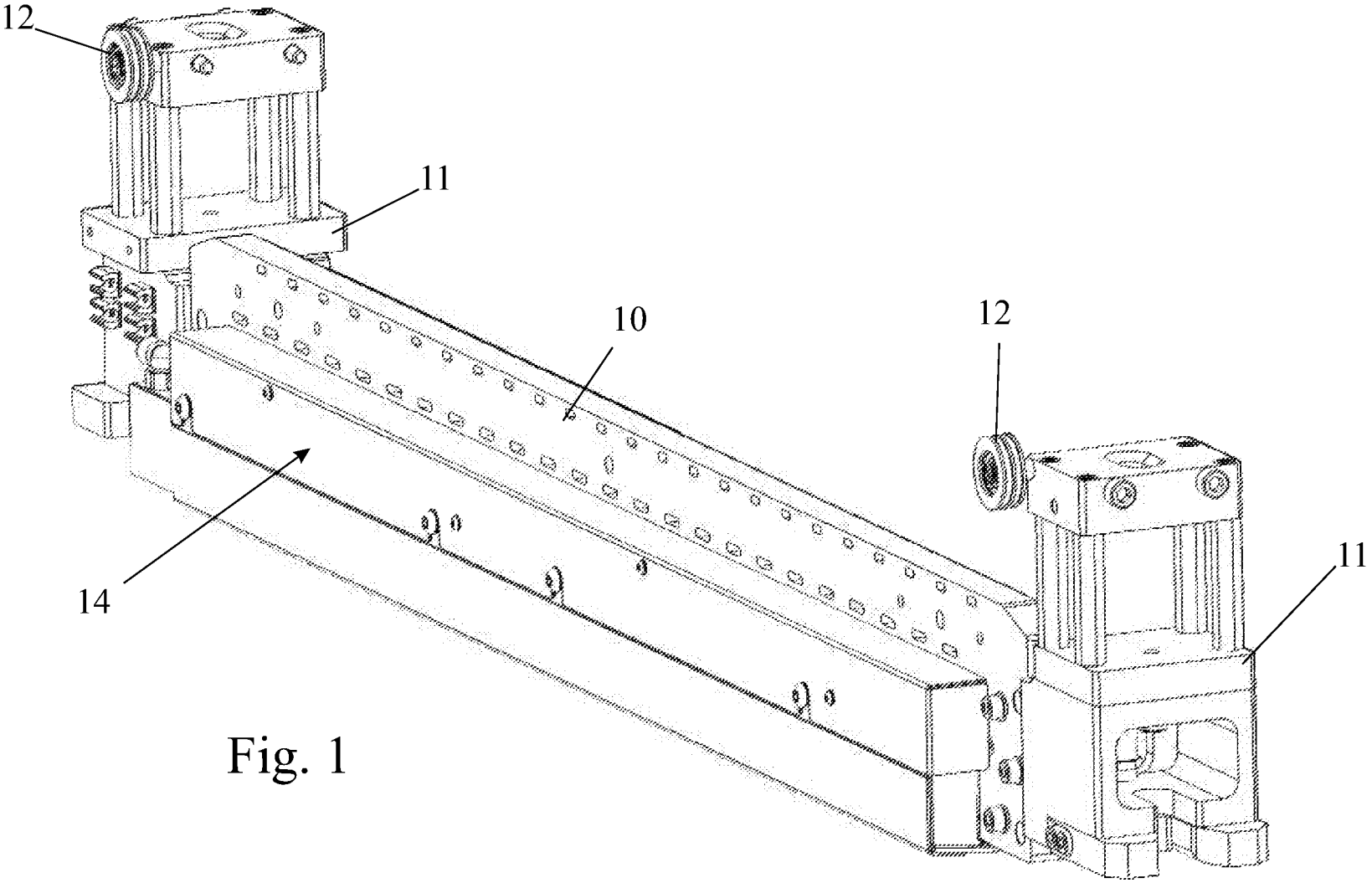
FIG. 1 is a perspective view of an assembled manifold secured to a print bar.

FIG. 1 shows a print bar 10 that is, in use, positioned immediately above the surface of an ITM having the form of a constantly recirculating endless belt. As described in WO2013/132418, an aqueous ink is jetted onto the surface of the ITM by print heads (not shown) mounted on the print bar 10. The resulting ink image is transported by the ITM to an impression station and during its transportation it is dried to leave behind a tacky ink residue. At the impression station, the ink residue is transferred onto a substrate and the ITM surface then returns to the print bar 10 to commence a new printing cycle.

The print bar 10 forms part of a carriage (not shown) that is supported by rollers 12 from a gantry to allow the print bar to be moved in a direction transverse to the direction of movement of the ITM between a deployed position in which it overlies the ITM and a parked position away from the ITM where servicing of print heads can take place.

A set of individual print heads (not shown) is secured to one side of the print bar 10, while a manifold 14 of the present disclosure is secured to its opposite side. The purpose of the manifold 14 is to deliver into the narrow gap between jetting nozzles of the print heads and the surface of the ITM two different gas streams. The first is a constant low speed laminar gas stream that is uniform across the width of the ITM, to cause main droplets and their satellites to merge on the surface of the ITM. The second is an intermittent high speed turbulent gas stream, to dislodge any condensation that may collect on the nozzle plates of the print heads. The second gas stream is intermittent because, being turbulent, it can only take place at times when no ink image is being formed on the ITM, so as to avoid image distortion. Furthermore, the drop in pressure caused by the high speed gas stream can lift the ITM off its support surface if applied across the entire width of the ITM at the same time and it is therefore divided in the illustrated embodiment into four separately controllable branches that can be delivered sequentially, or two at a time.

Figure 2:
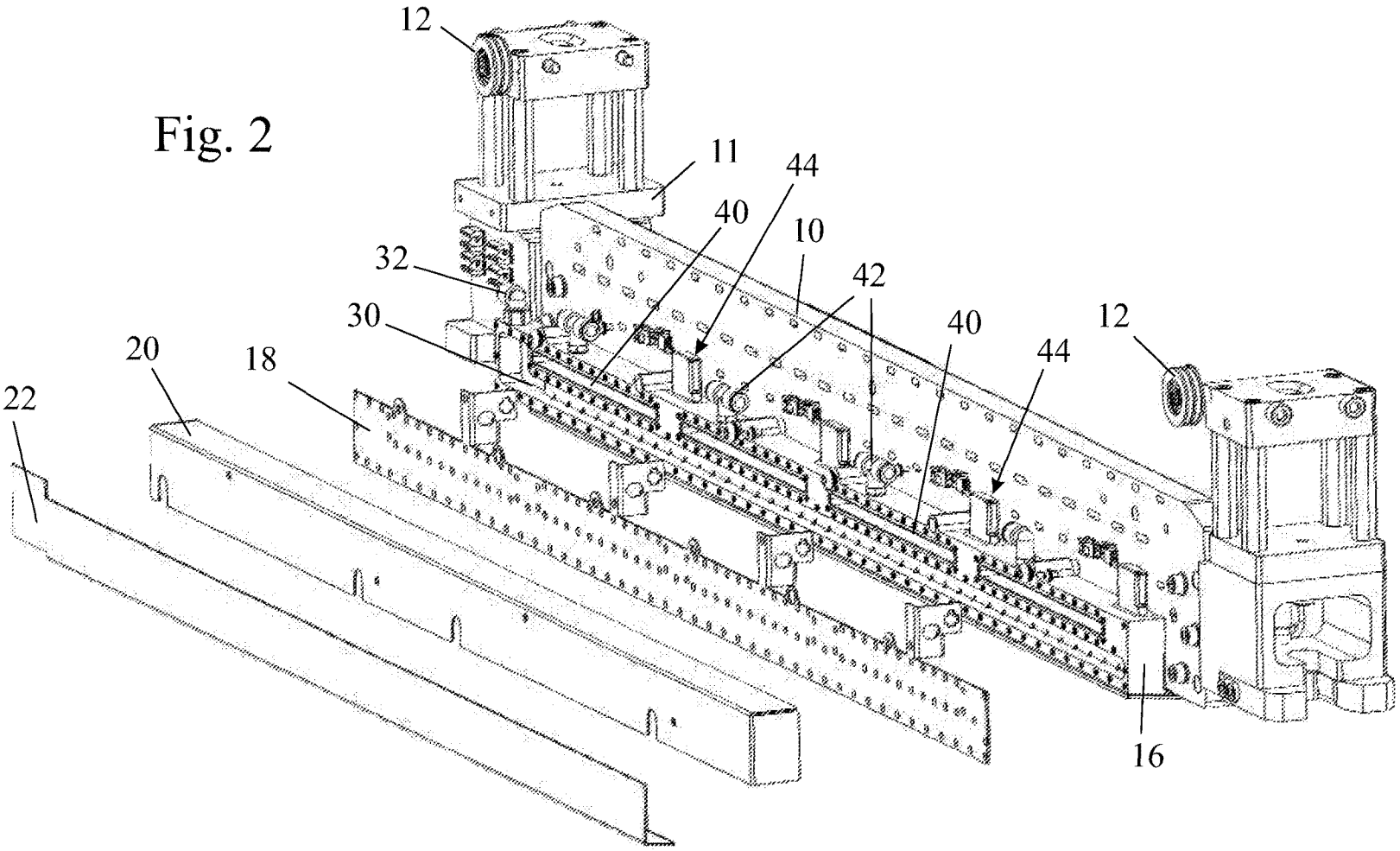
FIG. 2 is an exploded view of the manifold of FIG. 1 while still secured to the print bar.

Referring to FIG. 2, the manifold 14 is formed of a rectangular block 16 having various channels machined into its opposite sides. The channels on one side are sealed by the a cover and on the other side by a closure plate 18 to form different plenum chambers for gas, usually air, under two different pressures for delivery of the low and high speed streams. The figure also shows a protective cover plate 20 and a sponge layer 22 to prevent condensation on the cover surface. A top plate 24, a bottom plate 26 and a spacer 28, best seen in the exploded views of FIGS. 4 and 5, are secured to the underside of the block 16 to define the mouths of the manifold from which the two different gas streams are discharged.

Figure 3:
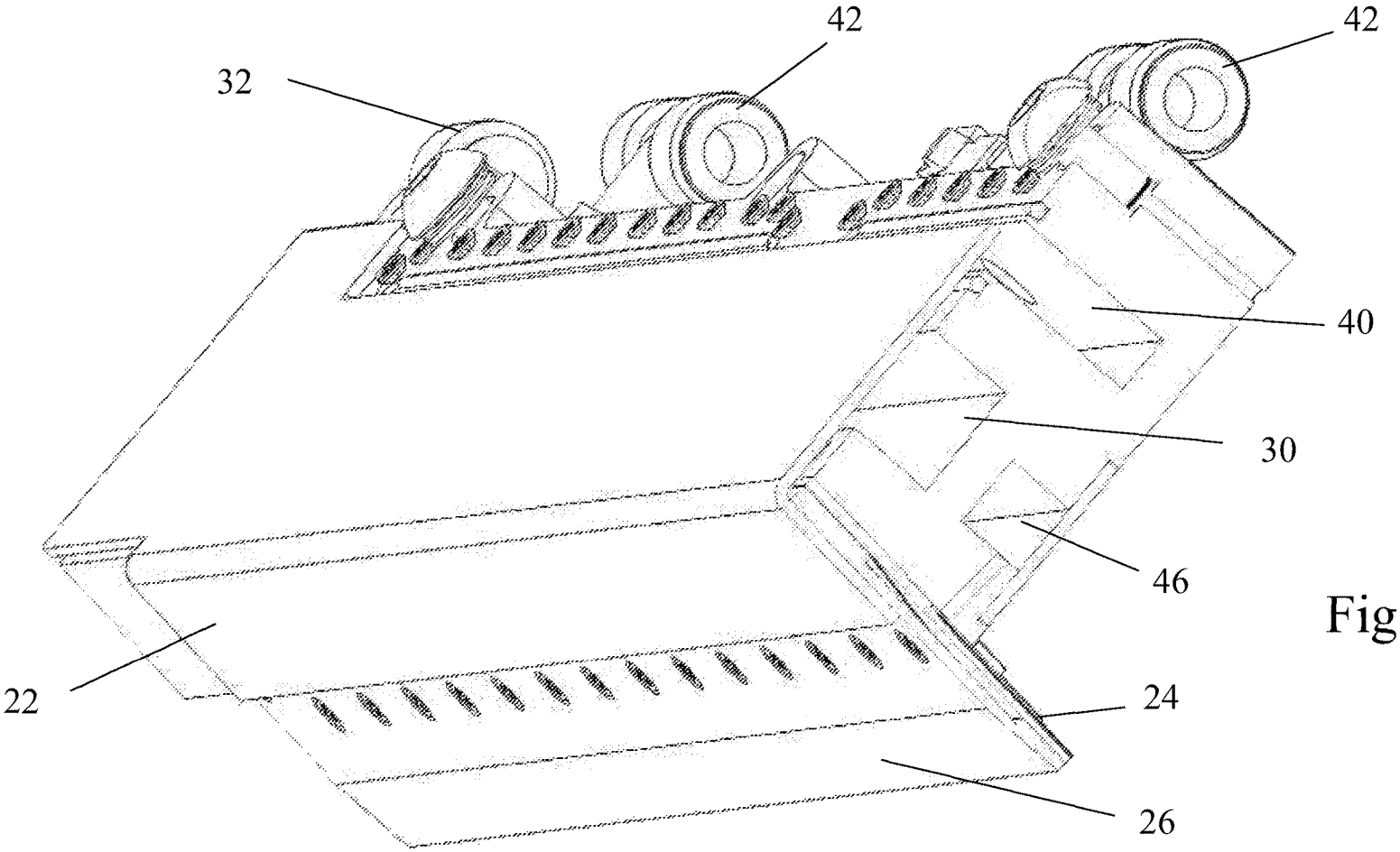
FIG. 3 shows a section through the manifold and part of the manifold when viewed from below.
Figure 4:
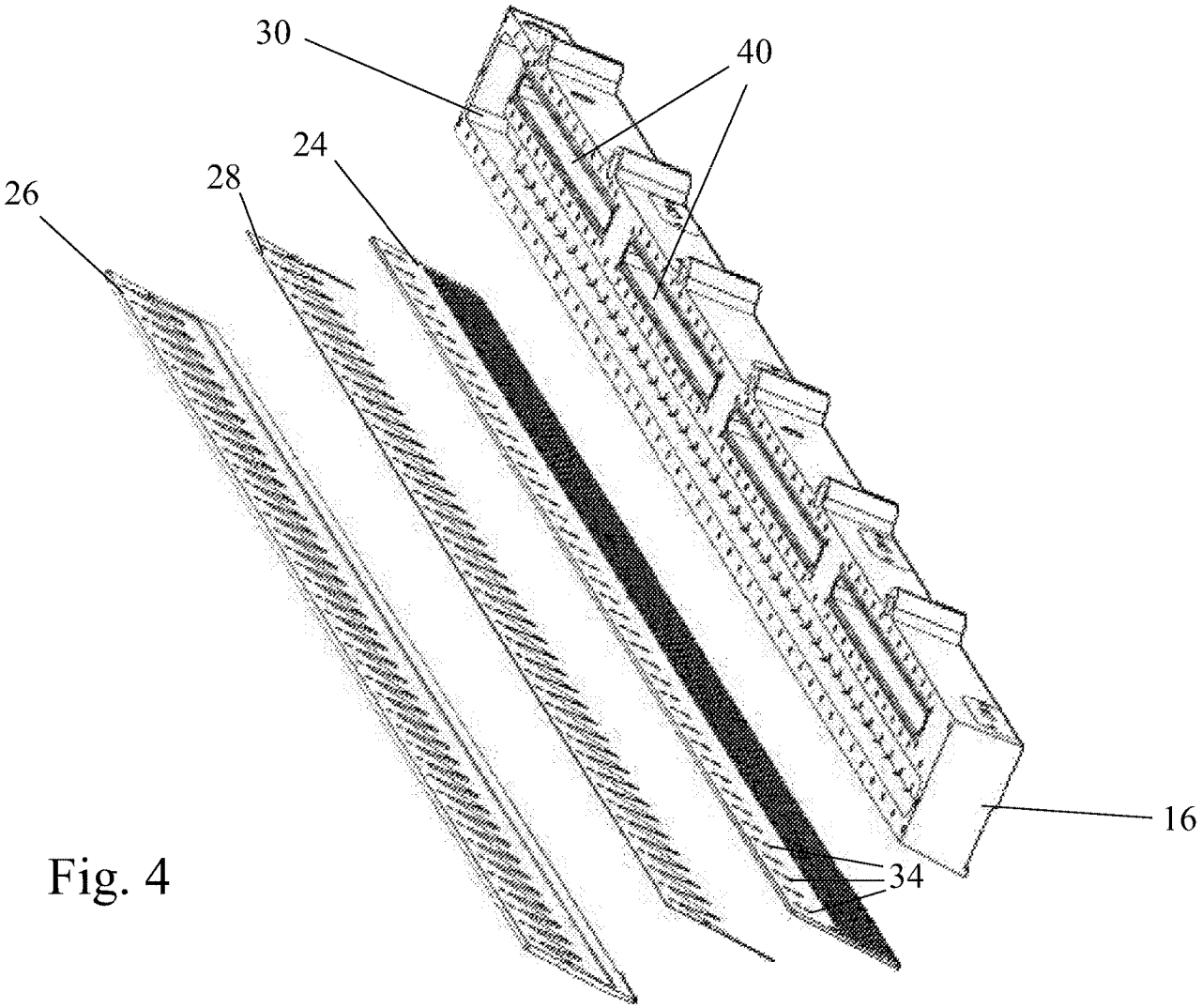
FIG. 4 is an exploded view showing the block of the manifold and plates secured to its underside to define the mouths for discharge of the low and high speed gas streams.
Figure 5:
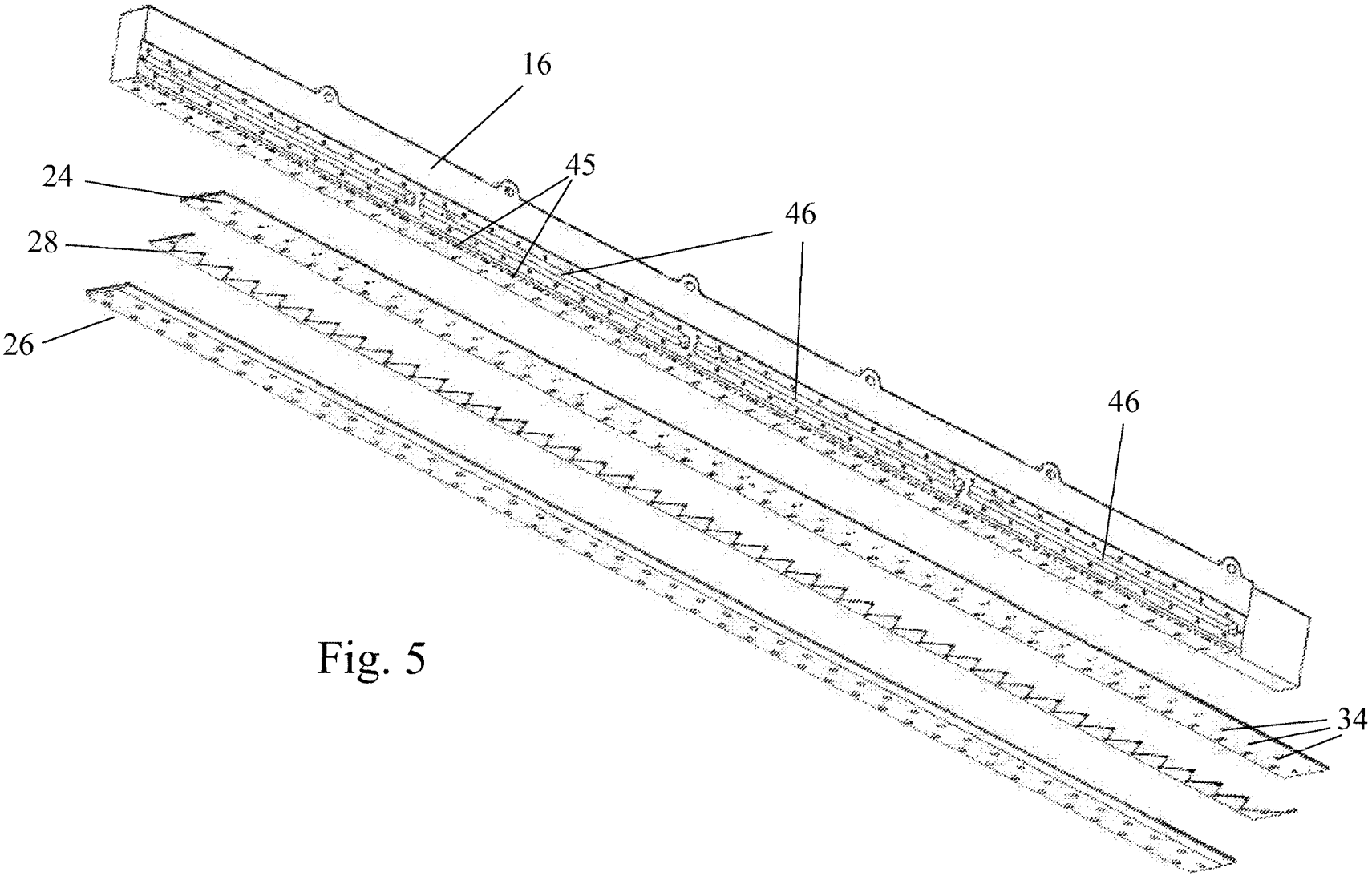
FIG. 5 is a similar exploded view to that of FIG. 4 but showing the manifold from the side facing to the print bar.

The single plenum chamber 30 for the low pressure gas used to deliver the low speed gas stream is formed by a single channel seen in FIGS. 2 and 4 and in section in FIG. 3) that extends across the full width of the manifold 14. The plenum chamber 30 is connected to a supply of gas under low pressure (for example 0.5 bar) by a connector 32. Small vertical holes 34 in the manifold block 16 and the top plate 24 (not shown in the block but visible in the top plate 24) allow gas from the plenum chamber 30 to pass to the low speed discharge mouth of the manifold, defined between the top plate 24 and the bottom plate 26 which are separated by the spacer 28 (seen in FIG. 4). The spacer 28 has a saw-tooth shaped edge that, together with depressions formed in the top surface of the bottom plate 26, defines diverging channels leading from the above-mentioned vertical holes in the manifold block to the common discharge mouth. The divergent channels guide the gas flowing to the discharge mouth to ensure that it leaves as a laminar gas stream that is uniform over the entire width of the discharge mouth.

Gas at high pressure, for example at a pressure of 3 to 6 bar, is fed, through respective connectors 42, into four separate second plenum chambers 40 defined by the block 16 and the cover plate 18. Each of the second plenum chambers 40 is connected by a respective valve 44, and vertical holes (not shown) within the block 16, to a respective buffer chamber 46 that is arranged on the opposite side of the block 16 from the plenum chamber 40. The buffer chambers 46 are closed off by a cover and can be seen in FIGS. 3 and 5. Pressurised gas from the buffer chambers 46 passes through further vertical holes in the block 16 that open onto grooves in the top plate 24, as best shown in FIG. 4. The upper surface of the top plate 24 together with the bottom surface of the block 16 form the second discharge mouth of the manifold 14, from which high speed gas is intermittently delivered into the gap between the print nozzles and the ITM.

The plates defining the discharge mouth from which the high speed gas is discharged need to be able to withstand the high gas pressure without buckling.

In the illustrated embodiment of the invention, this problem is overcome in that the block 16 itself acts as one side of the high speed gas discharge mouth and the pressure acting on the top plate 24 is resisted not by the top plate alone but by a sandwich consisting of the top plate 24, the bottom plate 26 and the spacer 28 between them. This sandwich, which is screwed to the underside of the block 16 can have a combined thickness approaching 4 mm and can therefore readily withstand the high pressure in the buffer chamber 46. The low speed gas is discharged from between the top plate 24 and the bottom plate 26 but the latter can readily withstand the low pressure without buckling.

In use, low speed gas is constantly discharged from the mouth defined between the top plate 24 and the bottom plate 26 and the plenum chamber 30 is constantly at the pressure of the low pressure gas supply. The plenum chambers 40, on the other hand are permanently connected to the high pressure gas supply but are isolated from the buffer chambers 46. Intermittently and individually, the second plenum chambers 40 are connected to their respective buffer chamber 46 by briefly opening the associated valves 44. This results in a volume of gas being transferred into the buffer chamber 46 and stored there temporarily at high pressure. This volume then escapes through the second discharge mouth of the manifold to cause a turbulent burst of gas flowing at high speed to pass between the printing nozzles and the ITM.

The valves 44 are not all opened simultaneously to avoid lifting the ITM off its support surface. They are instead either operated sequentially, or two at a time. In the latter case, it is preferred not to open the valves of adjacent buffer chambers 46 at the same time.

While the invention has been described by reference to only one embodiment, it will be clear to the person skilled in the art that various modifications may be made to the design of the manifold without departing from the scope of the invention as set out in the appended claims.

The invention claimed is:

1. A manifold for use in a printing system, in which a print head ejects ink droplets onto an intermediate transfer member (ITM) that is movable relative to the print head in a first direction and that is spaced from the print head by a gap that is traversed by the ink droplets, the manifold being adapted for introducing gas into the gap between the print head and the intermediate transfer member (ITM), the manifold having:

a first gas flow path terminating in a first discharge mouth for delivering a continuous low speed gas stream to flow through the gap along the first direction, said continuous low speed gas stream adapted to cause droplets of different sizes ejected by the print head to be transported to a different distance along the gap in said first direction by the low speed air stream before making contact with the ITM; and a second separate gas flow path terminating in a second discharge mouth, vertically spaced from the first discharge mouth, for intermittently delivering into the gap a high speed gas stream that flows along the first direction.

2. The manifold of claim 1, wherein said second gas flow path conducting the high speed gas stream is divided into a plurality of separate branches and high speed gas is made to flow through all the branches at different times.

3. The manifold of claim 2, wherein an entirely of said first discharge mouth is connected to a common single first plenum chamber that is connected at all times, during use, to a source of gas at low pressure.

4. The manifold of claim 2, wherein said second discharge mouth is divided into regions, each connected to a different respective flow path branch of said manifold, to receive gas at high pressure intermittently.

5. The manifold of claim 2, wherein the manifold comprises a block that, in use, is directly secured to a print bar that carries the print head.

6. The manifold of claim 5, wherein each of said branches conducting high speed gas comprises a plenum chamber connected to a supply of gas at high pressure and a buffer chamber intermittently connected to said plenum chamber by way of a respective valve, each of said buffer chambers being connected to a respective region of said second discharge mouth.

7. The manifold of claim 5, wherein said first and second discharge mouths are defined by a top plate, a bottom plate, and an intervening spacer that are secured to a low edge of said block, said first discharge mouth being defined between said top plate and said bottom plate, and said second discharge mouth being defined by groves in an upper surface of said top plate and an underside of said block.

8. The manifold of claim 7, wherein said spacer is shaped to define divergent channels each leading to said first discharge mouth from a respective hole in said block that communicates with said single plenum chamber of said first gas flow path.

9. A printing system comprising:

a. an intermediate transfer member (ITM);

b. an image forming station including at least one print head adapted to eject ink droplets onto an outer surface of said ITM, while said ITM is moving relative to said at least one print head in a first direction, so as to form ink images thereon, said at least one print head being separated from said ITM by a gap which is traversed by said ink droplets;

c. an impression station for transfer of the ink images from said ITM onto a printing substrate; and d. a manifold adapted for introducing gas into said gap between said at least one print head and said ITM, said manifold comprising:

i. a first gas flow path terminating in a first discharge mouth, said first gas flow path and said first discharge mouth adapted for delivering a continuous low speed gas stream to flow through said gap along said first direction, said continuous low speed gas stream adapted to displace ink droplets of different sizes, ejected by said at least one print head, to different distances along said first direction before said ink droplets of different sizes make contact with said ITM; and ii. a second gas flow path, separate from said first gas flow path and terminating in a second discharge mouth, vertically spaced from the first discharge mouth, for intermittently delivering into the gap a high speed gas stream.

10. The printing system of claim 9, wherein said at least one print head is adapted to eject a first ink droplet and a second ink droplet which is a satellite droplet of said first ink droplet, and wherein said continuous low speed gas stream is adapted to displace said first and second ink droplets to different distances along said ITM following ejection thereof by said at least one print head, such that said first ink droplet and said second ink droplet merge on said outer surface of said ITM.

11. The printing system of claim 9, wherein said second gas flow path and said second discharge mouth are adapted to intermittently deliver said high speed gas stream in a second direction, said second direction being non-orthogonal to said first direction.

12. The printing system of claim 11, wherein said second direction is along said first direction.

13. The printing system of claim 9, wherein said second gas flow path conducting said high speed gas stream is divided into a plurality of separate branches and said high speed gas steam is made to flow through all the branches at different times.

14. The printing system of claim 13, wherein said second discharge mouth is divided into regions, each connected to a different respective flow path branch of said manifold, to receive gas at high pressure intermittently.

15. The printing system of claim 13, wherein said image station further includes a print bar that carries said at least one print head, and said manifold further comprises a block that, in use, is directly secured to said print bar.

16. A manifold for introducing gas into a gap between a print head and an intermediate transfer member (ITM) of an indirect inkjet printing system, the manifold having a first gas flow path terminating in a first discharge mouth for delivering a continuous low speed gas stream, and a second separate gas flow path terminating in a second discharge mouth, vertically spaced from said first discharge mouth, for intermittently delivering into said gap a high speed gas stream, wherein said second gas flow path conducting said high speed gas is divided into a plurality of separate branches and high speed gas is made to flow through all said plurality of separate branches at different times, and wherein said second discharge mouth is divided into regions each connected to a different respective flow path branch of said manifold to receive gas at high pressure intermittently.

17. The manifold of claim 16, further comprising a block that, in use, is directly secured to a print bar that carries said print head.

18. The manifold of claim 17, wherein each of said branches conducting high speed gas comprises a plenum chamber connected to a supply of gas at high pressure and a buffer chamber intermittently connected to said plenum chamber by way of a respective valve, each of said buffer chambers being connected to a respective region of said second discharge mouth of said manifold.

19. The manifold of claim 17, wherein said first and second discharge mouths of said manifold are defined by a top plate, a bottom plate and an intervening spacer that are secured to a low edge of said block, said first discharge mouth, for said continuous low speed gas stream, being defined between said top plate and said bottom plate and said second discharge mouth, for said intermittent high speed gas, being defined by groves in an upper surface of said top plate and an underside of said block.

20. The manifold of claim 19, wherein said spacer is shaped to define divergent channels each leading to said first discharge mouth from a respective hole in said block that communicates with said single plenum chamber of said first flow path.

* * * * *